US009364094B2

(12) United States Patent
Python

(10) Patent No.: US 9,364,094 B2
(45) Date of Patent: Jun. 14, 2016

(54) POOL LOUNGE THAT FACILITATES INTERACTIONS BETWEEN TWO PEOPLE

(71) Applicant: Steven K. Python, San Francisco, CA (US)

(72) Inventor: Steven K. Python, San Francisco, CA (US)

( * ) Notice: Subject to any disclaimer, the term of this patent is extended or adjusted under 35 U.S.C. 154(b) by 32 days.

(21) Appl. No.: 14/524,600

(22) Filed: Oct. 27, 2014

(65) Prior Publication Data

US 2015/0140880 A1 May 21, 2015

Related U.S. Application Data

(60) Provisional application No. 61/907,313, filed on Nov. 21, 2013.

(51) Int. Cl.
*B63C 9/08* (2006.01)
*A47C 15/00* (2006.01)
*A47C 27/08* (2006.01)

(52) U.S. Cl.
CPC ..... *A47C 15/008* (2013.01); *A47C 27/081* (2013.01)

(58) Field of Classification Search
CPC ..... A47C 15/008; A47C 27/081; B63B 35/74
USPC ..... 441/130
See application file for complete search history.

(56) References Cited

U.S. PATENT DOCUMENTS 299,951 A * 6/1884 Brown ..... B63B 35/74 411/130
5,186,667 A * 2/1993 Wang ..... B63B 35/76 114/345
9,051,032 B2 * 6/2015 Hanel ..... B63B 35/74

* cited by examiner

*Primary Examiner* — Stephen Avila

(57) ABSTRACT

A floating pool lounge is disclosed. The floating pool lounge has a head end and a foot end, and includes an opening between the head end and the foot end. The opening extends through the thickness of the lounge and is sized to admit a human head. The pool lounge may also include handles disposed on respective sides, and a head and cervical support disposed around the opening toward the foot end. In some embodiments, particularly where the pool lounge is not rigid enough to resist movement, it may carry a series of connected channels or pockets, and substantially rigid frame members may be connected within the channels or pockets to rigidify the structure.

17 Claims, 3 Drawing Sheets

POOL LOUNGE THAT FACILITATES INTERACTIONS BETWEEN TWO PEOPLE

BACKGROUND OF THE INVENTION

1. Field of the Invention

In general, the invention relates to floating pool lounges, and particularly to floating pool lounges designed to facilitate interactions between two people.

2. Description of Related Art

Floating chaise lounges are common in pools and other swimming locations. The typical floating chaise lounge provides sufficient buoyant force to float on the surface of a body of water while a single person lies on it, typically with legs stretched out and supported horizontally. Floating chaise lounges may be of a variety of types, and use a variety of different structures and methods to provide buoyancy: some are shaped, inflatable bladders, while others use metal or plastic frames with large blocks of foam to provide buoyancy.

In addition to swimming and lounging, pools play host to any number of activities, ranging from water games to sex. However, traditional floating chaise lounges are not designed for activities involving two people—in many cases, the weight of two people is enough to capsize or sink the lounge, but even if a lounge provides sufficient buoyant force for two people, it may be difficult for two people to position themselves comfortably on it.

SUMMARY OF THE INVENTION

One aspect of the invention relates to a floating pool lounge. The floating pool lounge comprises a support made of a buoyant material or a material that can be made buoyant. The support has a head portion and a foot portion opposite the head portion. An opening is provided in the support between the head portion and the foot portion, the opening extending through the thickness of the support. In some embodiments, the pool lounge may also include handles disposed at respective sides of the support. The handles may extend both above and below the support, so that they can be used by a person resting on the support and by others around or under the support. A head and cervical support cushion may be provided around the opening on the side closer to the foot portion of the support. The opening itself may be sized to allow the passage of a human head.

Another aspect of the invention also relates to a floating pool lounge. The pool lounge includes a support made of a buoyant material or a material that can be made buoyant. The support has a head portion, a foot portion, and an opening positioned approximately midway between the head and the foot portions. The opening extends through the thickness of the support. A head cushion is connected to the head portion, and a cervical cushion is provided around the perimeter of the opening. The support may include a set of connected channels that extend around at least its perimeter, and a set of substantially rigid frame members that can be inserted into the channels to reinforce the support. The support may be formed from, e.g., a closed-cell, buoyant foam.

These and other aspects, features, and advantages of the invention will be set forth in the description that follows.

BRIEF DESCRIPTION OF THE DRAWING FIGURES

The features of the invention will be described with respect to the following drawing figures, in which like numerals represent like elements throughout the views, and in which.

DETAILED DESCRIPTION

Figure 1:
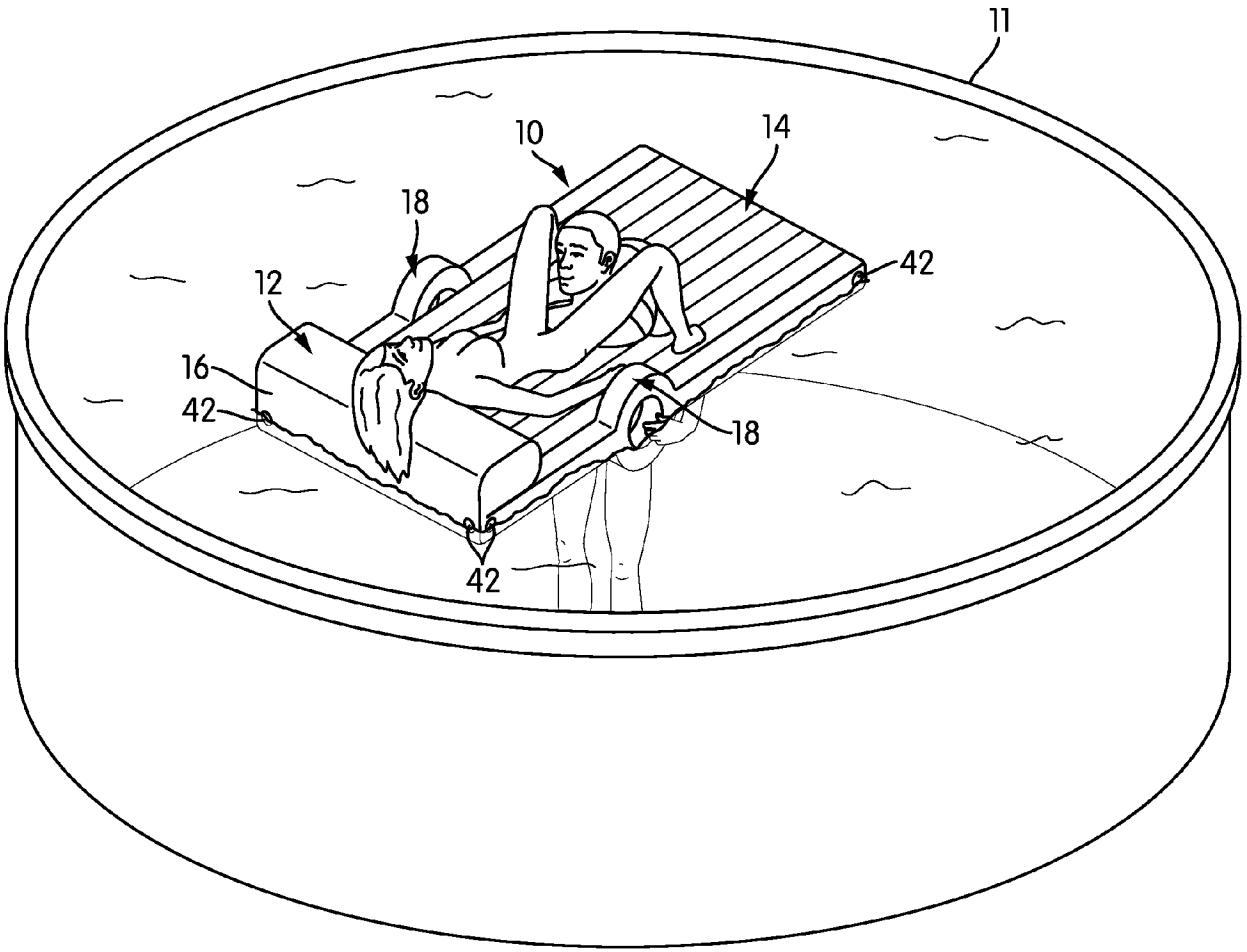
FIG. 1 is a perspective view of a floating pool lounge in use according to one embodiment of the invention.

FIG. 1 is a perspective view of a floating pool lounge, generally indicated at 10, according to one embodiment of the invention. The view of FIG. 1 illustrates the pool lounge 10 in use, floating in a pool 11, as will be described below in more detail.

Generally speaking, the pool lounge 10 is a support and cushion made of a buoyant material or a material that can be made buoyant. As can be seen from FIG. 1 and the top plan view of FIG. 2, the pool lounge 10 has an overall shape similar to typical floating pool lounges: it is elongate and generally rectangular in plan view, and has a head end 12 and a foot end 14. In the illustrated embodiment, at the head end 12, the pool lounge 10 includes a head cushion 16 to support the head. It should be understood that while the head cushion 16 is of a size and thickness that supports the person's head in a substantially supine position, embodiments of the pool lounge 10 may include head cushions 16 and other structure to support a person's head and back in a sitting position.

Most pool lounges have handles and armrests of various sorts, some of which are equipped with cup holders and other such accoutrements. The pool lounge 10 of the illustrated embodiment has handles 18, one on each side of the lounge 10, that are in some respects similar to those found on typical pool lounges. However, as will be described below in more detail, because the pool lounge 10 is adapted to facilitate interaction between two people, it is advantageous if either the handles 18 are adapted to be used by both people or, alternatively, a second set of handles is provided for the second person.

Figure 3:
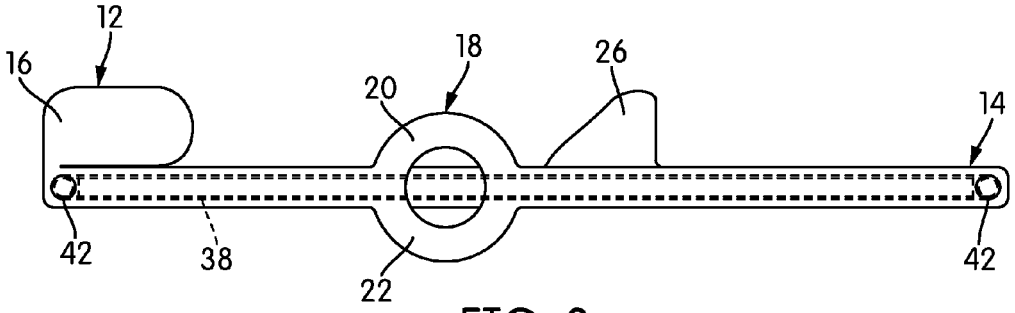
FIG. 3 is a side elevational view of the pool lounge of FIG. 1.

As can be seen in FIG. 1 and in the side elevational view of FIG. 3, the handles 18 each have an upper portion 20 and a connected lower portion 22. Each of the two portions 20, 22 is semicircular, and they connect to one another to form a fully connected circle through the thickness of the lounge 10. The lower portion 22 is designed to extend below the waterline when the pool lounge 10 is in use, meaning that a second user can grip the handles 18 from under the water, as shown in FIG. 1. There is no requirement that the upper and lower portions 20, 22 be connected, or that they be co-located. However, the arrangement shown may add additional rigidity.

The overall shape of the pool lounge 10 is not critical to the invention, and in some embodiments, it may have other shapes. In particular, it need not be rectilinear or flat, and could be contoured for aesthetic reasons, or to provide specific support for parts of the body, in other embodiments.

The pool lounge 10 also includes an opening 24 positioned approximately midway between the head portion 12 and the foot portion 14. The opening 24 of the illustrated embodiment is elliptical, although it may be round, polygonal, or any other shape in other embodiments.

The opening 24 allows access from the pool lounge 10 to the water below, and vice-versa. That access may allow the user to view the water below, and may facilitate any number of games or other kinds of interaction with swimmers and divers below the surface. For example, children may play "peek-a-boo" in the pool using the pool lounge 10 without having to pull on its edges and risk capsizing it.

The opening 24 may also allow two people to have sex, and particularly oral sex or cunnilingus, without sinking or capsizing the pool lounge 10. As is shown in essence in FIG. 1, the person receiving cunnilingus would lie on the lounge 10 with their pelvis proximate to the opening 24, typically with legs open, while the person giving cunnilingus would be either standing on the bottom of the pool or floating with his or her head protruding through the opening 24, facing toward the head portion 12. Of course, many positional variations are possible. Around the portion of the opening 24, closer to the foot end 14, the pool lounge 10 of the illustrated embodiment includes an optional head and cervical support 26 to provide support to the head and neck of the person whose head extends through the opening 10. The head and cervical support 26 extends around the perimeter of the opening 24.

It should be understood that while the pool lounge 10 and its features may facilitate certain acts, the pool lounge 10 may be used in a variety of different ways, including the non-sexual uses set forth above. Even in situations in which the pool lounge 10 is used for intimate purposes and encounters between two or more people, it may be used for other purposes than those described above. For example, the opening 20 may provide access for intimate massage.

Depending on the embodiment, the pool lounge 10 may be inflatable, in which case it would comprise a soft, flexible bladder made of a material such as PVC. However, it may be particularly helpful if the pool lounge 10 is made of materials that provide both buoyancy and a degree of rigidity. Additional rigidity may be helpful because, as described above, the pool lounge 10 may be used for more active pursuits than prior art floating lounges.

In one embodiment, for example, the pool lounge 10 may be made from sections of a closed-cell foam, such as a polyethylene or PVC foam, similar to the foam of which conventional "pool noodles" are made. A section of foam several inches thick, e.g., 3-6 inches, may be used for the pool lounge 10. Other portions of the lounge 10, like the handles 18 and the head cushion 16 may also be made of the same type of foam. The pool lounge 10 may be made of a single unitary piece of foam; if it is not, the separate pieces of the pool lounge 10 may be attached by common techniques like fusing or adhesives. In some embodiments, connectors may be provided, and the pool lounge 10 assembled by the end user.

There may be situations in which the pool lounge 10 is made of a material that, by itself, does not have all of the necessary rigidity. There may also be situations in which it is desirable to make the pool lounge 10 out of a more flexible material, for example, so that it can be folded or rolled for shipping. In those situations, the pool lounge 10 may be provided with a number of channels 38, 40 that run through a significant portion of it, and a set of reinforcing members may be provided separately and inserted into the channels 38, 40 before use.

Figure 2:
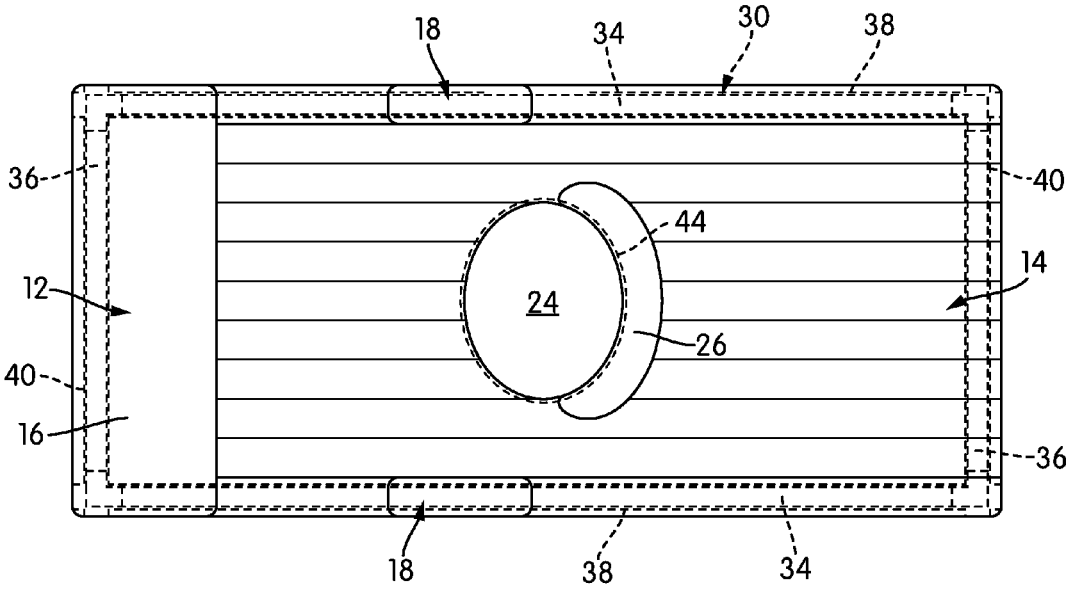
FIG. 2 is a top plan view of the floating pool lounge of FIG. 1.

For example, as shown particularly in FIG. 2, the pool lounge 10 may include a rectangular frame 32 that extends around its perimeter. The frame 32 includes two long members 34 that run essentially the entire length of the pool lounge 10 and two short members 36 that extend the width of the pool lounge 10. The members 34, 36 extend within channels 38, 40 that are formed in the pool lounge 10. The members 34, 36 are typically connected with connectors at their corners, such that the frame 32 is continuous.

Figure 4:
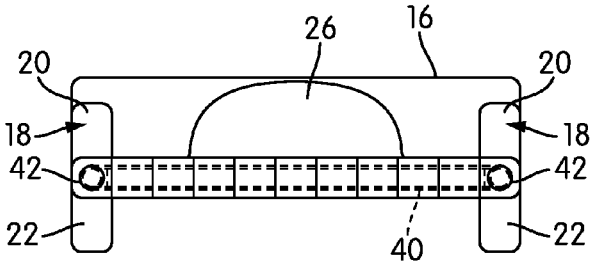
FIGS. 4 and 5 are respective end elevational views of the pool lounge of FIG. 1.
Figure 5:
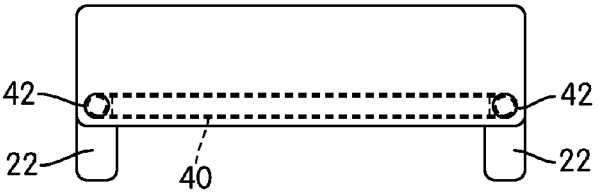

In some cases, the frame 32 may be installed at the time of manufacture. However, for the reasons described above, it may be advantageous for the frame 32 to be installed after manufacture and shipping, by the end user. For that reason, removable plugs 42 in the sides and the ends of the pool lounge 10, visible in the side view of FIG. 3 and the respective end views of FIGS. 4 and 5, open into the channels 38, 40, allowing a user to place the frame members 34, 36. In one embodiment, the frame members 34, 36 may be, for example, PVC pipes. It should be understood that although the channels 38, 40 and frame 32 are internal in the illustrated embodiment, the frame 32 may be external in some embodiments, in which case the channels 38, 40 would comprise pockets around the external perimeter of the pool lounge 10.

Even if the pool lounge 10 is not generally reinforced, specific features or portions of the pool lounge 10 may be reinforced with parts shaped for the purpose. For example, the circumference or perimeter of the opening 24 may be reinforced, for example, with a stiff band of plastic or coated metal 44, best seen in FIG. 2. This may help to prevent the opening 24 from narrowing or closing around a person's head or neck if the pool lounge 10 undergoes an abrupt or extreme movement. Similarly, the pair of handles 18 may be reinforced to provide a solid grip and support for a person lying on the pool lounge 10. In some embodiments, the frame 32 could also be cross-braced by additional channels that extend diagonally from the corners of the frame 32 and meet at the reinforcing collar 44 of the opening 24.

The dimensions of the pool lounge 10 may vary from embodiment to embodiment. As those of skill in the art will appreciate from the description above, whatever the size of the pool lounge 10 itself, in most, if not all, embodiments, the opening 20 will be of sufficient size to admit an adult human head. Additionally, while FIG. 1 illustrates a single person on the pool lounge 10 and a single person in the pool 11, the pool lounge 10 may be sized to accommodate multiple people on it, and multiple people interacting with it. For example, a pool lounge according to another embodiment of the invention may be made with approximately double the width of the illustrated embodiment, so as to accommodate two people on it. A second opening 24 could be provided for the use of the second person.

Although the opening 24 conveys certain advantages, in some embodiments, an insert may be provided that can be inserted into the opening 24 to close it. The insert may be secured with any kind of conventional fasteners. With an insert in the opening 24, the pool lounge 10 can be used as a conventional pool lounge. In embodiments where an insert is provided, the cervical support 26 around the opening 24 may be removable.

While the invention has been described with respect to certain embodiments, the description is intended to be exemplary, rather than limiting. Modifications and changes may be made within the scope of the invention, which is defined by the appended claims.

What is claimed is:

1. A floating pool lounge, comprising:

a support made of a buoyant material or a that can be made buoyant, the support having a head portion;

a foot portion opposite the head portion, the support defining an opening between the head portion and the foot portion, the opening extending through a thickness of the support and providing access between a reclining surface of the pool lounge and water beneath the pool lounge;

a cervical support arranged around a circumference or perimeter of the opening configured to provide cervical support for a user inserting his/her head through the opening from the water beneath the pool lounge to interact with an occupant of the pool lounge; and handles disposed on respective sides of the support each of said handles comprising an upper portion and a connected lower portion, the lower portion configured to extend below a waterline when the pool lounge is in use, each portion being semicircular, the two connected portion forming a fully connected circle.

2. The floating pool lounge of claim 1, wherein the Opening is of sufficient size to admit at least an average-sized human head.

3. The floating pool lounge of claim 1, further comprising a head support within the head portion.

4. The floating pool lounge of claim 1, wherein the support has a generally rectangular shape.

5. The floating pool lounge of claim 1, wherein the support is made of a closed-cell buoyant foam.

6. The floating pool lounge of claim 1, further comprising one or more reinforcements around a circumference or perimeter of the opening.

7. The floating pool lounge of claim 1, wherein the support defines a series of connected channels that extend at least around its perimeter.

8. The floating pool lounge of claim 7, further comprising a set of substantially rigid frame members that assemble within the connected channels to form a frame for the support.

9. The floating pool lounge of claim 8, wherein the substantially rigid frame members comprise plastic pipes.

10. A floating pool lounge, comprising:

a support made of a buoyant material or a material that can be made buoyant, the support having a head portion, a foot portion opposite the head portion, and an opening defined between the head portion and the foot portion, the opening extending through a thickness of the support and providing access between a reclining surface of the pool lounge and water beneath the pool lounge;

a head cushion connected to the head portion; and a cervical support arranged around the perimeter of the opening configured to provide cervical support for a user inserting his/her head through the opening from the water beneath the pool lounge to interact with an occupant of the pool lounge; and handles disposed above and below the support, each of said handles comprising an upper portion and a connected lower portion, the lower portion configured to extend below a waterline when the pool lounge is in use, each portion being semicircular, the two connected portions forming a fully connected circle.

11. The floating pool lounge of claim 10, wherein the support further comprises a set of connected channels that extend at least around the perimeter of the support.

12. The floating pool lounge of claim 11, further comprising a set of connectable, substantially rigid frame members that are constructed and adapted to fit within the set of connected channels to form a frame for the support.

13. The floating pool lounge of claim 12, wherein the substantially rigid frame members comprise plastic pipes.

14. The floating pool lounge of claim 10, wherein the support has a generally rectangular shape.

15. The floating pool lounge of claim 10, wherein the support is made of a closed-cell buoyant foam.

16. The floating pool lounge of claim 10, wherein the support is of sufficient size for a person to lie on it, and the opening is of sufficient size to admit an adult human head.

17. The floating pool lounge of claim 10, further comprising a reinforcing collar around a perimeter of the opening.

* * * * *